US005169459A

United States Patent [19]

Fukushima et al.

[11] Patent Number: 5,169,459

[45] Date of Patent: Dec. 8, 1992

[54] MATERIALS AND MEMBERS FOR APPARATUSES USING ALCOHOLIC FUELS, WHICH ARE EXCELLENT IN PEEL RESISTANCE

[75] Inventors: Katsuaki Fukushima, Shimane; Toshio Okuno; Masakazu Ito, both of Yasugi, all of Japan

[73] Assignee: Hitachi Metals, Ltd., Tokyo, Japan

[21] Appl. No.: 729,391

[22] Filed: Jul. 12, 1991

[30] Foreign Application Priority Data

Nov. 21, 1990 [JP] Japan ..... 2-316554
Apr. 1, 1991 [JP] Japan ..... 3-094839

[51] Int. Cl.[5] ..... C22C 38/22; C22C 38/24
[52] U.S. Cl. ..... 148/325; 148/333
[58] Field of Search ..... 148/325, 333; 420/39, 420/69

[56] References Cited

U.S. PATENT DOCUMENTS 2,478,723 8/1949 Trantin, Jr. ..... 148/325

FOREIGN PATENT DOCUMENTS 46-31658 9/1971 Japan ..... 148/325
56-112442 9/1981 Japan ..... 420/39
1016393 5/1983 U.S.S.R. ..... 148/325

OTHER PUBLICATIONS

Design Engineering, "Soft Magnetic Stainless Steel for Electric Fuel Injector", p. 16, London, May 1989.

*Primary Examiner*—Deborah Yee
*Attorney, Agent, or Firm*—Finnegan, Henderson, Farabow, Garrett & Dunner

[57] ABSTRACT

The present invention provides a material which is superior in all of peel resistance, corrosion resistance and abrasion resistance against alcoholic fuels.

The material comprises an Fe-Cr-C based steel or Fe-Cr-C-Cu based steel. For applications wherein members formed from the material are subjected to impacts, the Cr content is within the range of at least 8.0% and less than 16.0%, the relation between the C content and the Cr content satisfies % Cr+25×% C≦32 based on weight, and the ratio of the area of a primary carbide to the total sectional area of the material is 1.5% or less. For non-impact applications Cr content is more than 12.0% and less than 16.0%, % C and % Cr satisfy % Cr+25×% C>32, and the ratio of the area of a primary carbide to the total sectional area of the material is 8.0% or less. This material is especially superior in peel resistance against alcoholic fuels. The Fe-Cr-C based steel may optionally contain Cu, Si, Mn, W, Mo, V, Co, and Ni.

20 Claims, 3 Drawing Sheets

(No. 1)

OB123-16

(No. 5)

OB-123-12

MATERIALS AND MEMBERS FOR APPARATUSES USING ALCOHOLIC FUELS, WHICH ARE EXCELLENT IN PEEL RESISTANCE

BACKGROUND OF THE INVENTION

1. Field of the Invention

The present invention relates to material and members suitable for making apparatus in which are used, stored, or conveyed, alcohol fuels or alcohol-mixed petroleum fuels herein generically called alcoholic fuels including these fuels and organic fuels such as ethers, particularly for pumps, nozzles, valves and other members having to striking or sliding members in electronic fuel injection systems of internal combustion engines.

2. Description of Related Art

Petroleum fuels such as gasoline and light oil have been used in internal combustion engines for automobiles, and in the case of internal combustion engines in which these fuels are used, electronic fuel injection systems controlled by computers are used for cleaner exhaust gases, improvement in power and performance, and reduction of fuel expenses to bring good results. In electronic fuel injection systems, a heat treated SUS440C (corres. to AISI440C) steel specified in JIS which is superior in wear resistance is used for a valve portion (electronic fuel injection nozzle) for supply and control of fuels, and the valve portion is generally used without need for replacement before the car is scrapped.

As the fuels of internal combustion engines for automobiles, use of alcoholic fuels in place of petroleum fuels has been investigated for the reasons of recent circumstances relating to petroleum (increase of petroleum availability costs and reduction in production) and for diminishing exhaust gases (NOx), and some alcoholic fuels have been subjected to practical tests.

Use of methyl alcohol, ethyl alcohol, methyl-tert-butyl ether and the like has been examined as alcoholic fuels.

These alcoholic fuels are inferior in lubricity to petroleum fuels and there are the problems of occurrence of abrasion and peeling of materials of rotors in fuel pumps and sliding parts or parts subjected to striking-type contact in fuel injection nozzles, and also and the problem of corrosion of fuel systems caused by water contained in alcoholic fuels, oxides of alcohols (acetaldehyde, formaldehyde), and impurities in alcoholic fuels (acetic acid, formic acid).

As materials for members of devices in which alcoholic fuels are used, Japanese Patent Kokoku (Post-Exam. Publication) Nos. Hei 1-15585 and 1-15584 and Japanese Patent Kokai (Laid-Open) No. Sho 62-93347 have proposed Fe-based sintered alloys having both abrasion resistance and corrosion resistance for fuel pumps which are steels containing Nb as an essential component, steels containing at least one of P and B and at least one of Ti and Zr as essential components, and steels containing only C and Ni as additive elements, respectively. Furthermore, Japanese Patent Kokai (Laid-Open) No. Sho 61-6260 has proposed steel sheets for fuel tanks, but abrasion resistance and peel resistance have not been considered.

In the development of materials for members of devices in which alcoholic fuels are used, the inventors have conducted a working test where a closed circuit of a fuel tank, a fuel pump and an electronic fuel injection nozzle is used an alcoholic fuel is circulated to operate the electronic fuel injection nozzle, and an investigation of the valve portion of, the nozzle in an alcohol fuel engine is made after the valve portion is subjected to a practical test. As a result, the inventors have confirmed that deterioration of the valve in shielding properties readily occurs when the injection nozzle is made of conventional SUS440C steel.

The part having deteriorated shielding properties was microscopically examined. As a result, it has been found that corrosion wear and peeling owing to striking contact occurred in the surface portion of the nozzle (which wear and peeling are called "fretting abrasion" or "fretting fatigue") as shown in FIG. 4 and this is a cause for deterioration of the shielding or protective qualities of the material.

SUMMARY OF THE INVENTION

The object of the present invention is to provide materials which are excellent especially in peel resistance (fretting abrasion resistance) in addition to the corrosion resistance and abrasion resistance which have been demanded in using alcoholic fuels, for example, materials inhibited from the deterioration of the shielding properties when used as an electronic fuel injection nozzle for alcoholic fuels, and which can be obtained by a conventional melting method without employing a powder metallurgy method.

In accordance with the present invention, a material excellent in peel resistance and especially usable for members of an apparatus in which alcoholic fuels are used, comprises an FeCr-C steel, in which the relation between the C content and the Cr content in % by weight satisfies $\%Cr+25\times\%C\leqq 32$, and the area ratio of a primary carbide occupying the sectional area of the material is 1.5% or less. The material may further contain 3% or less of Cu.

Further in accordance with the present invention, a material excellent in peel resistance and usable for members of an apparatus in which the member is subjected to striking-type impacts and in which alcoholic fuels are used comprises an Fe-Cr-C-Cu steel having, by weight, at least 0.60% and less than 0.80% of C, 1.5% or less of Si, 1.5% or less of Mn, at least 8.0% and less than 16.0% of Cr, 0.5 to 3.5% of at least one of W and Mo in $\frac{1}{2}W+Mo$, 0.02 to 1.5% of V, 0.05 to 3.0% of Cu, and the remainder of Fe and unavoidable impurities. The relation between the C content and the Cr content satisfies $\%Cr+25\times\%C\leqq 32$, and the ratio of the area of a primary carbide to the total sectional area of the material is 1.5% or less. The material may further contain at least one of 0.1 to 5.0% of Co and 2% or less of Ni.

Still further in accordance with the present invention, a third basic invention which is a material excellent in peel resistance and used for sliding members and the like such as injection pump members receiving relatively few impacats in an apparatus in which alcoholic fuels are used, characterized in that the material comprises, by weight, at least 0.60% and less than 0.80% of C, 1.5% or less of Si, 1.5% or less of Mn, more than 12.0% and less than 16.0% of Cr, 0.5 to 3.5% of at least one of W and Mo in $\frac{1}{2}W+Mo$, 0.02 to 1.5% of V, 0.05 to 3.0% of Cu, and the balance of Fe and unavoidable impurities. The relation between the C content and the Cr content satisfies $\%Cr+25\times\%\ C>32$, and the area ratio of a primary carbide occupying the sectional area of the material is 8.0% or less. The materials may further contain Co and Ni and have a hardness HRC of at least 52.

DETAILED DESCRIPTION OF PREFERRED EMBODIMENTS

Figure 1A:
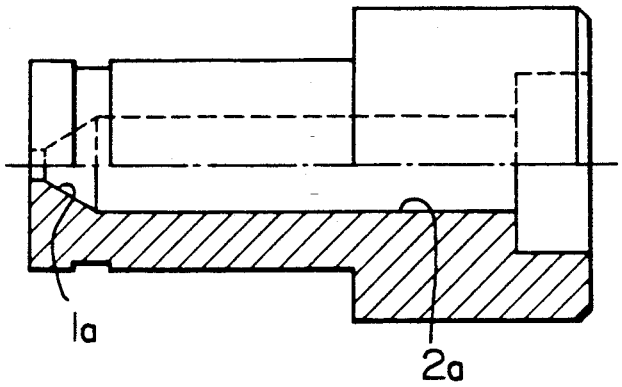
FIGS. 1A and 1B are partial sectional views of an electronic fuel injection nozzle (the former shows a body and the latter a needle) used for the abrasion test and the peel test.

That is, the present invention relates to materials especially suitable for members in alcoholic fuel systems such as a body and needle of a nozzle which are required to have a peel resistance and abrasion resistance against contact with alcoholic fuels. Specifically, the present invention relates to a first basic invention which is a material excellent in peel resistance and used for members of an apparatus in which alcoholic fuels are used, characterized in that the material is an Fe-Cr-C steel, the relation between the C content and the Cr content in % by weight satisfies $\%Cr + 25 \times \%C \leqq 32$, and the area ratio of a primary carbide occupying the sectional area of the material is 1.5% or less, wherein the material may further contain 3% or less of Cu a the invention also relates to second basic invention which is a material excellent in peel resistance and used for members or an apparatus in which alcoholic fuels are used, characterized in that the material is an Fe-Cr-C-Cu steel comprising, by weight, at least 0.60% and less than 0.80% of C, 1.5% or less of Si, 1.5% or less of Mn, at least 8.0% and less than 16.0% of Cr, 0.5 to 3.5% of at least one of W and Mo in $\frac{1}{2}W + Mo$, 0.02 to 1.5% of V, 0.05 to 3.0% of Cu, and the remainder of FE and unavoidable impurities. The relation between the C content and the Cr content satisfies $\%Cr + 25 \times \%C \leqq 32$, and the area ratio of a primary carbide occupying the sectional area of the material is 1.5% or less. The material may further contain at least one of 0.1 to 5.0% of Co and 2% or less of Ni. a the invention still further relates to third basic invention which is a material excellent in abrasion resistance and used for sliding members and the like such as injection pump members receiving relatively few impacts in an apparatus in which alcoholic fuels are used, characterized in that the material comprises, by weight, at least 0.60% and less than 0.80% of C, 1.5% or less of Si, 1.5% or less of Mn, more than 12.0% and less than 16.0% of Cr, 0.5 to 3.5% of at least one of W and Mo in $\frac{1}{2}W + Mo$, 0.02 to 1.5% of V, 0.05 to 3.0% of Cu, and the balance of Fe and unavoidable impurities. The relation between the C content and the Cr content satisfies $\%Cr + 25 \times \%C > 32$, and the area ratio of a primary carbide occupying the sectional area of the material is 8.0% or less. The material may further contain Co and Ni in the same manner as in the second invention; furthermore, the material of the above second and third inventions can additionally contain 0.1 to 5.0% of Co and have a hardness HRC of at least 52.

As mentioned above, the inventors analyzed the inner surface of a nozzle and a needle made of a SUS440C steel which deteriorated in shielding properties and found that abrasion of sliding members and peeling phenomenon of the portion exposed to striking occurred in the end portion and corrosion occurred in the tip portion, resulting in deterioration of shielding properties.

Under the circumstances, relations between the chemical composition and corrosion, abrasion and resistance were investigated as explained below.

(1) Corrosion

In the case of alcoholic fuels, corrosion of materials is caused by water contained in the fuels and acetic acid and formic acid as impurities in the fuels. In order to investigate the influence of chemical compositions of the materials on the corrosion atmosphere, Fe-based materials containing various alloy elements and 0.5–1.0% of C were immersed in water +10% acetic acid +10% formic acid solution at 60° C. for 30 hours to obtain corrosion loss in weight and influence of the respective alloy elements was examined. The materials used in the corrosion test were all those which had been subjected to oil quenching at 1050° C., subzero treatment at −78° C. and tempering at 180° C.

Relation between chemical composition and corrosion loss in weight was obtained based on the results of the experiments by regression analysis to find that Cr, Ni, V, and Cu are the elements which improve the corrosion resistance, C and Mn are the elements which degrade the corrosion resistance, and Co, Si, W, and Mo have no significant influence on corrosion resistance.

(2) Abrasion

Figure 1B:
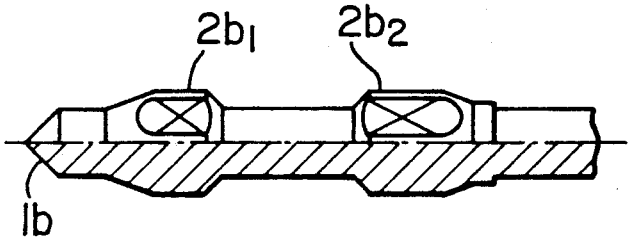

An electronic fuel injection nozzle comprises a needle and a body in which the needle is inserted. Therefore, regarding the abrasion, first an actual electronic fuel nozzle was subjected to operational testing of $2 \times 10^8$ with a mixed fuel comprising 85% of industrial methylcycles alcohol and 15% of gasoline and the abrasion state was examined and the relation with hardness of materials was investigated. FIGS. 1A and 1B show the nozzle comprising a body (FIG. 1A) and a needle (FIG. 1B) having respective sliding and striking surface portions 1*a*, 1*b* and a sliding surface portions 2*a*, 2*b*, 2*b*$_2$.

The composition of the material used in the tests was 0.69C-9.3Cr-1.01Mo-0.25V-1.06Co-0.46Cu-Fe. This was subjected to quenching at 1050° C. and sub-zero treatment and was adjusted to four kinds of hardnesses, HRC63, 60, 57.5, and 55 by changing the tempering temperature. Needles and bodies of injection devices for electronic fuels were made from these materials and were subjected to operational testing.

As a result, it was found that abrasion wear was less with increase in hardness.

Then, relation between abrasion wear and microstructure or added elements were evaluated by the electronic fuel injection test conducted in the examples given hereinafter.

With reference to the relation between microstructure and abrasion wear, if the materials had the same level of hardness, those having the structure where a primary carbide remained were somewhat better in abrasion resistance. With reference to the influence of the added elements on abrasion, the materials containing Co were effective.

When this test was conducted on the needle and the body made of different materials from each other, and if either one of them contained a microstructurally large carbide which remained in a large amount abrades, the material having a higher hardness would abrade a larger amount of the other material. Therefore, the needle and the body were made of the same material and subjected to the test.

(3) Peeling

The peeling phenomenon of the portions in the body and needle of an electronic fuel injection nozzle which are subjected to striking has brought about no problems in the case of the conventional petroleum fuels such as gasoline and this is a peculiar problem peculiar to when alcoholic fuels are used. This peeling phenomenon is such a that the portion just under the surface of the member subjected to striking cleaves and is broken due to repeated stresses thereafter peels off creating a surface appearance and as if pores are formed on the surface. It is considered that this phenomenon occurs conspicuously because the lubricity of alcoholic fuels is inferior to that of petroleum fuels and so, the lubricity between the members is damaged and the striking or impinging action between the needle and the body increases. With reference to this peeling, the following relation between the peeling and microstructure or hardness was recognized as a result of the electronic fuel injection tests shown in the examples given hereinafter.

(1) The peeling phenomenon is less likely to occur for the materials having higher hardness.

Figure 3A:
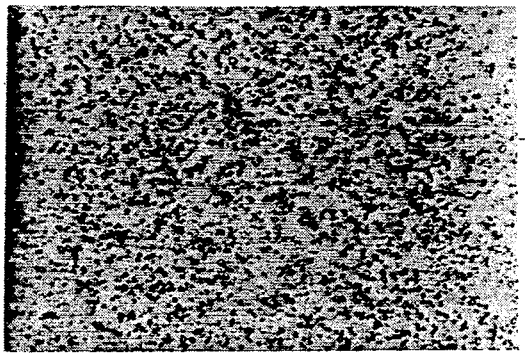
FIGS. 3A and 3B are micrographs (×100) which show the microstructures subjected to quenching and tempering in the areas (A) and (B).
Figure 3B:
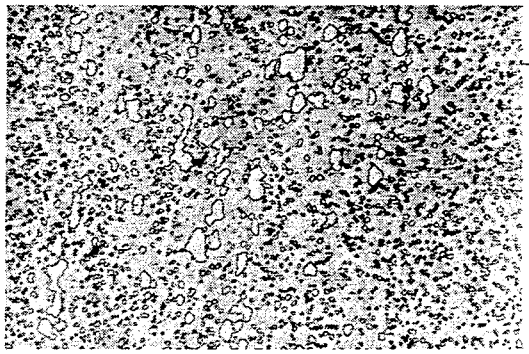
Figure 4:
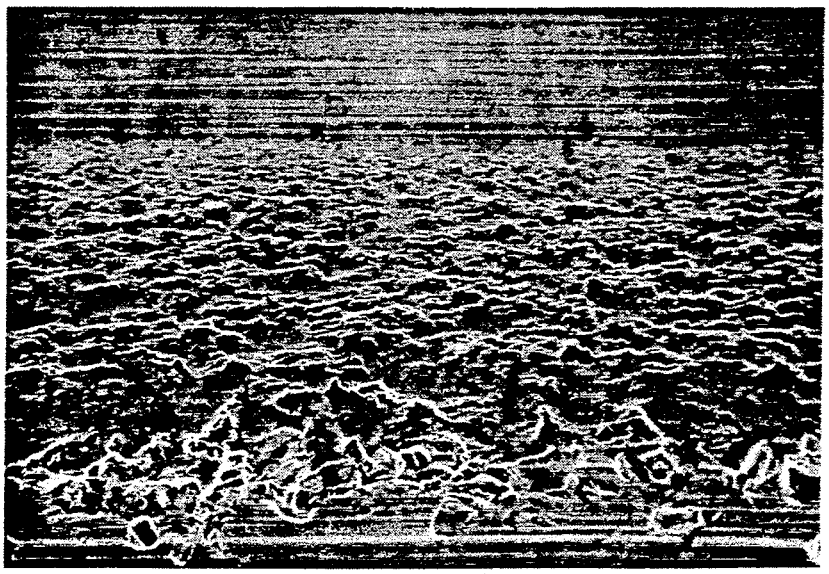
FIG. 4 is a micrograph showing the abraded condition of the portion subjected to striking and the peeling action of especially carbides of a SUS440C steel, which is a material typically used at present, when an injection nozzle made of the steel was operated using an alcohol fuel (a mixture of 85% of methyl alcoholic and 15% of gasoline).

(2) Microstructurally, the peeling phenomenon more readily occurs with an increase in continuous distribution of a coarse primary carbide as shown in FIG. 3B (micrograph of x400). The inventors have determined that it is necessary that the amount of the primary carbide is controlled so that the ratio of the area rate of the primary carbide to the total section area is 1.5% or less by microstructural observation of the section and the structure should preferably be as shown in FIG. 3A. For this purpose, the contents of C and Cr should be adjusted to control the amount of the primary carbide.

The present invention has been accomplished based on the above findings.

That is, the present invention relates to a material suitable for the members of devices subjected to striking in which alcoholic fuels are used and in addition to improved corrosion resistance and abrasion resistance, this material is improved in peel resistance which is a property required for materials for members subjected to striking impact of devices in which especially alcoholic fuels are used by limiting the C and Cr contents to the ranges where the crystallization of a minimum amount of primary carbides occurs. Crystallization of the primary carbide in the compositions of the present invention occurs with the C content and the Cr content of nearly $\%Cr + 25 \times \%C = 32$ and therefore the relative amounts of C and Cr are made to be $\%Cr + 25 \times \%C < 32$ as shown by area (A) in FIG. 2 in order to limit to 1.5% or less the area of the primary carbide relative to the total sectional area under microstructural observation.

Materials used as members exposed to alcoholic fuels, are used not only for, the members subjected to striking, but also for non striking members, which members are nevertheless, required to have an abrasion resistance at a level similar to the peel resistance. In this case, the condition for controlling crystallization of a primary carbide is $Cr + 25 \times \%C > 32$ as shown by the area (B) in FIG. 2. However, it is desirable that the materials have such component ranges that the ratio of the area of the primary carbide to the total sectional area of the sample cross section (hereinafter "afterratio") is 8% or less. These materials are improved in abrasion resistance to some extent as mentioned above.

Reasons for limitation of the chemical compositions of the materials of the present invention will be explained.

Carbon (C) is an essential element for maintaining martensite in a quenched structure, enhancing the hardness, producing carbides and increasing the abrasion resistance. Addition of at least 0.6% of C is necessary for increasing the hardness of the material after subjected to quenching to a level required for a body and needle of fuel injection nozzle. If the added amount of C is too much, reduction in corrosion resistance to acetic acid + formic acid is brought about and hence the upper limit is set at less than 0.8%.

Furthermore, for materials used as members which receive striking such as a body or needle for an injection nozzle and piston rings in devices in which alcoholic fuels are used, since primary carbides are produced in a large amount at the time of solidification depending on the relative ratio to the amount of Cr and degrades the peel resistance of the members exposed to striking, the value of $\%Cr + 25 \times \%C$ is specified to be 32 or less as the range where the area ratio of the remaining primary carbide does not exceed 1.5% in the composition system of the present invention.

To the contrary, as materials for members of devices in which alcoholic fuels are which members are used and used in parts which undergo no special striking contact but which require abrasion resistance, such as a plunger and body used for an injection pump of a diesel engine, further improvement of abrasion resistance is achieved by adjusting the amounts of Cr and C to satisfy the condition $\%Cr + 25 \times \%C > 32$ which is the condition to produce the primary carbide (with a proviso that the area ratio of the primary carbide is 8% or less).

Silicon (Si) has the effect of strengthening the base and increase the abrasion resistance by forming a solid solution with the base. Moreover, when the material is subjected to low temperature tempering and used as in the present invention, Si has the effect of increasing the resistance to temper softening. However, if Si is added in a large amount, hot workability is damaged and the amount of Si is 1.5% or less.

Manganese (Mn) is an essential element for refining of steel, but if it is present in a large amount, austenite is stabilized and residual austenite increases and, as a result, hardness by heat treatment is achieved only with difficulty and corrosion resistance to acetic acid and formic acid contained in alcoholic fuels is degraded. Thus, the amount of Mn is 1.5% or less.

Chromium (Cr) also has an effect to improve corrosion resistance to acetic acid and formic acid contained in alcoholic fuels. Moreover, as a carbide forming element, it produces a chromium carbide and improves abrasion resistance. If the amount of Cr is too large, the hardness after heat treatments (quenching and tempering) is achieved only with difficulty. Furthermore, the primary carbide is produced due to the relation of Cr with the C content, and the tendency of the member portion subjected to striking to experience peeling increases in alcoholic fuels. Therefore, the amount of Cr is held to at least 8.0% but less than 16% and the relation between the C content and the Cr content is limited to satisfy $\%Cr+25\times\%C \leqq 32$.and the primary carbide area ratio is decreased to as small as 1.5% or less, taking the peel resistance into consideration.

Alternatively, in order to mainly deal with improvement of abrasion resistance against reduction in lubricity owing to the use of alcoholic fuels, primary carbide is crystallized to achieve an area ratio of 8% or less, and the amount of Cr is adjusted to be more than 12.0% but less than 16.0% and to satisfy $\%CR + 25 \times \%C > 32$.

Molybdenum (Mo) and tungsten (W) are essential for improvement of hardenability, increase of quenching hardness and improvement of abrasion resistance, but they are not needed to be added in large amounts. If they are contained in large amounts, hot workability deteriorates due to the production of coarse carbides and at least one of W and Mo is contained in an amount of 0.5–3.5% when calculated or as $\frac{1}{2}W + Mo$. A preferred range of $\frac{1}{2}W + Mo$ is 0.5–2.0%.

Vanadium (V) is effective for homogenization of the structure of the material of the present invention and is further effective for improvement of corrosion resistance test against acetic acid and formic acid contained in alcoholic fuels. However, if it is contained in a large amount, too much primary carbide is formed and, hence, the amount of V is 0.02–1.5%, preferably 0.1–1.0%.

Copper (Cu) is the element which is most effective for improvement of corrosion resistance to acetic acid and formic acid contained in alcoholic fuels, but addition of it in a large amount causes reduction of tempering hardness and deterioration of hot workability. Therefore, the amount of Cu is 0.05–3.0%, preferably 0.5–3.0%.

Cobalt (Co) is effective especially for improvement of abrasion resistance, and seizing resistance and the effect is demonstrated in the examples given below. Regarding the amount of Co, addition of Co in an amount of 5.0% or less markedly improves the abrasion resistance and this effect of Co addition in an amount of more than 5.0% gradually increases, however, co addition in a large amount greater than 5% also reduces toughness. Therefore, the amount of Co added is 0.1–5.0%. A preferred range is 0.5–2.5%.

Nickel (Ni) is effective for enhancing the corrosion resistance to acetic acid and formic acid contained in alcoholic fuels and increases toughness of steel. However, if it is contained in a large amount, the critical temperature decreases and residual austenite is readily produced. Therefore, the upper limit of Ni content is 2.0%.

EXAMPLES

The present invention will be explained in more detail by the following examples.

First, steels having the compositions shown in Table 1 were produced by a melting method and the respective molten steels were cast into individual ingots. These ingots were subjected to diffusion annealing at a high temperature, then hot working and annealing to make the desired test materials.

TABLE 1

| | | | | | | | | (wt %) | | | | | | | | |
|---|---|---|---|---|---|---|---|---|---|---|---|---|---|---|---|---|
| | No. | C | Si | Mn | P | S | Ni | Cr | Mo | W | V | Co | Cu | Fe | Cr + 25C | Claim No. |
| The materials of the present invention | 1 | 0.66 | 0.70 | 0.46 | 0.005 | 0.004 | — | 11.0 | 0.78 | — | 0.28 | 1.57 | 0.99 | Bal | 27.5 | 4 |
| | 2 | 0.71 | 1.02 | 0.46 | 0.005 | 0.003 | — | 13.2 | 0.52 | — | 0.28 | 1.54 | 0.97 | " | 31.0 | 4 |
| | 3 | 0.77 | 0.98 | 0.51 | 0.010 | 0.003 | 0.71 | 10.1 | 0.99 | 0.50 | 0.35 | 1.07 | 0.98 | " | 29.4 | 5 |
| | 4 | 0.76 | 0.98 | 0.51 | 0.015 | 0.003 | 1.37 | 11.7 | 0.51 | 0.30 | 0.86 | — | 1.51 | " | 30.7 | 6 |
| | 5 | 0.70 | 1.01 | 0.46 | 0.004 | 0.005 | — | 15.2 | 1.00 | — | 0.08 | — | 0.94 | " | 32.7 | 7 |
| | 6 | 0.70 | 0.55 | 0.51 | 0.016 | 0.003 | 0.92 | 13.3 | 1.00 | — | 0.36 | — | 0.10 | " | 30.8 | 6 |
| | 7 | 0.76 | 0.71 | 0.77 | 0.010 | 0.003 | — | 15.2 | 2.51 | 0.31 | 0.31 | 2.47 | 1.70 | " | 34.2 | 8 |
| | 8 | 0.77 | 0.69 | 0.74 | 0.010 | 0.004 | 1.51 | 15.5 | 1.01 | 0.07 | 0.32 | 1.07 | 1.59 | " | 34.8 | 9 |
| | 9 | 0.76 | 0.98 | 0.51 | 0.009 | 0.004 | 1.50 | 14.7 | 0.96 | — | 0.30 | — | 1.57 | " | 33.7 | 10 |
| | 10 | 0.72 | 0.51 | 0.50 | 0.016 | 0.002 | — | 13.1 | 1.01 | — | 0.35 | — | 2.96 | " | 31.1 | 3 |
| | 11 | 0.69 | 0.52 | 1.44 | 0.016 | 0.003 | — | 9.3 | 2.81 | — | 0.36 | 1.06 | 0.25 | " | 26.6 | 4 |
| | 12 | 0.62 | 1.40 | 0.93 | 0.015 | 0.002 | — | 8.3 | 2.51 | 1.01 | 1.35 | — | 0.38 | " | 23.8 | 3 |
| | 13 | 0.79 | 1.25 | 0.75 | 0.014 | 0.003 | — | 15.4 | — | 0.67 | 0.26 | 4.90 | 0.49 | " | 35.2 | 8 |
| Comparative materials | 14 | 0.52 | 1.02 | 0.52 | 0.016 | 0.002 | — | 15.8 | 1.00 | — | 0.37 | 2.31 | 0.97 | Bal | 28.8 | — |
| | 15 | 0.84 | 1.01 | 0.48 | 0.017 | 0.002 | — | 1.57 | 0.57 | — | 0.28 | 1.71 | 0.54 | " | 36.7 | — |
| | 16 | 0.96 | 0.41 | 0.36 | 0.020 | 0.006 | — | 16.5 | 0.40 | — | — | — | — | " | 40.5 | — |
| | 17 | 0.38 | 0.51 | 0.61 | 0.023 | 0.005 | 0.31 | 12.7 | — | — | — | — | — | " | 22.2 | — |
| | 18 | 0.67 | 0.27 | 0.53 | 0.017 | 0.003 | 0.24 | 12.5 | — | — | — | — | — | " | 29.3 | — |

No. 16: This material corresponds to SUS440C.
No. 17: This material corresponds to SUS420J2.

Sample No. 16 and Sample No. 17 made as comparative materials correspond to SUS440C and SUS420J2 according to JIS, respectively.

Then, the respective test materials were kept at 1050° C. for 20 minutes and thereafter, subjected to oil-cooling, subzero treatment at −100° C., tempering at 150° C. and then finish working, and these were used for testing. The test results are shown in Table 2.

TABLE 2

| | No. | Hardness (HRC) | Corrosion resistance | Abrasion resistance | Peel resistance | Area ratio of primary carbide (%) |
|---|---|---|---|---|---|---|
| The materials of the present invention | 1 | 61.7 | ○ | ○ | ○ | 0 |
| | 2 | 61.0 | ○ | ○ | ○ | 0.3 |
| | 3 | 63.2 | ○ | ○ | ○ | 0.1 |
| | 4 | 61.6 | ○ | ○ | ○ | 0.2 |
| | 5 | 59.2 | ○ | ○ | Δ | 2.4 |
| | 6 | 61.4 | ○ | ○ | ○ | 0.3 |
| | 7 | 59.7 | ○ | ○ | Δ | 4.2 |

TABLE 2-continued

| | No. | Hardness (HRC) | Corrosion resistance | Abrasion resistance | Peel resistance | Area ratio of primary carbide (%) |
|---|---|---|---|---|---|---|
| | 8 | 59.7 | ○ | ○ | Δ | 6.2 |
| | 9 | 61.7 | ○ | ○ | Δ | 3.6 |
| | 10 | 63.0 | ○ | ○ | ○ | 1.0 |
| | 11 | 63.2 | ○ | ○ | ○ | 0 |
| | 12 | 61.2 | ○ | ○ | ○ | 0 |
| | 13 | 60.7 | ○ | ○ | Δ | 7.3 |
| Comparative materials | 14 | 57.2 | ○ | X | ○ | 0 |
| | 15 | 61.4 | Δ | ○ | X | 12.4 |
| | 16 | 61.3 | X | ○ | X | 22.6 |
| | 17 | 55.4 | ○ | X | ○ | 0 |
| | 18 | 62.1 | X | Δ | ○ | 0.1 |

Heat treatment of the material: After keeping at 1050° C. for 20 min. oil-cooling → subzero treatment of −100° C. → tempering at 150° C.

With reference to the hardness, HRC hardness was measured after the materials were subjected to working at 1050° C. for,, 20 minutes, oil-quenching, subzero treatment at −100° C. and then tempering at 150° C.

Corrosion resistance was evaluated by an immersion test in a solution of water +10% acetic acid 10% formic acid at 60° C. for 30 hours and a solution of industrial methyl alcohol +10% acetic acid +10% formic acid at 20° C., for 200 hours. The results are shown by the following criteria.

"X" Test result was similar to that of SUS440C.

"○": The sample was not corroded at all.

"Δ" : The sample was somewhat corroded.

Abrasion resistance and peel resistance were evaluated in the following manner. The test material was made into a needle type electronic fuel injection nozzle as shown in FIG. 1 and 1B and this nozzle was subjected to an operation test of $2\times10^8$ times using a mixed fuel comprising 85% of industrial methanol and 15% of gasoline. The surfaces subjected to striking and the sliding surfaces were examined.

The abrasion wear was measured based on the original profiles of the sliding surface and the surface of the member subjected to striking, and the results are shown in Table 2 by the following criteria.

"X" more than 5 μm

"Δ" : 3–5 μm

"○" less than 3 μm

Peeling was evaluated by observing the needle surface subjected to striking by a scanning electron microscope and the results are shown in Table 2 by the following criteria.

"X ": Peeling defects were seen in the form of a ring (overall surface).

"Δ" : Peeling defects were sporadically present.

"○" : No peeling defects were present.

It can be seen from the results in Table 2 that the materials of the present invention are superior in corrosion resistance and peel resistance to SUS440C (Sample No. 16) conventionally used in petroleum fuels and tested as comparative material and besides, are superior in abrasion resistance to SUS420J2 (Sample No. 17) and thus are most suitable for alcoholic fuels.

The materials shown in Table 1 having a value of Cr +25C. of more than 32 (Sample Nos. 5, 7, 8, 9, and 13) show some peeling in the use as members subjected to striking as shown in Table 2, but they can be used for members which are expected to undergo no striking or members subjected to only sliding, in view of their abrasion resistance and corrosion resistance.

Figure 2:
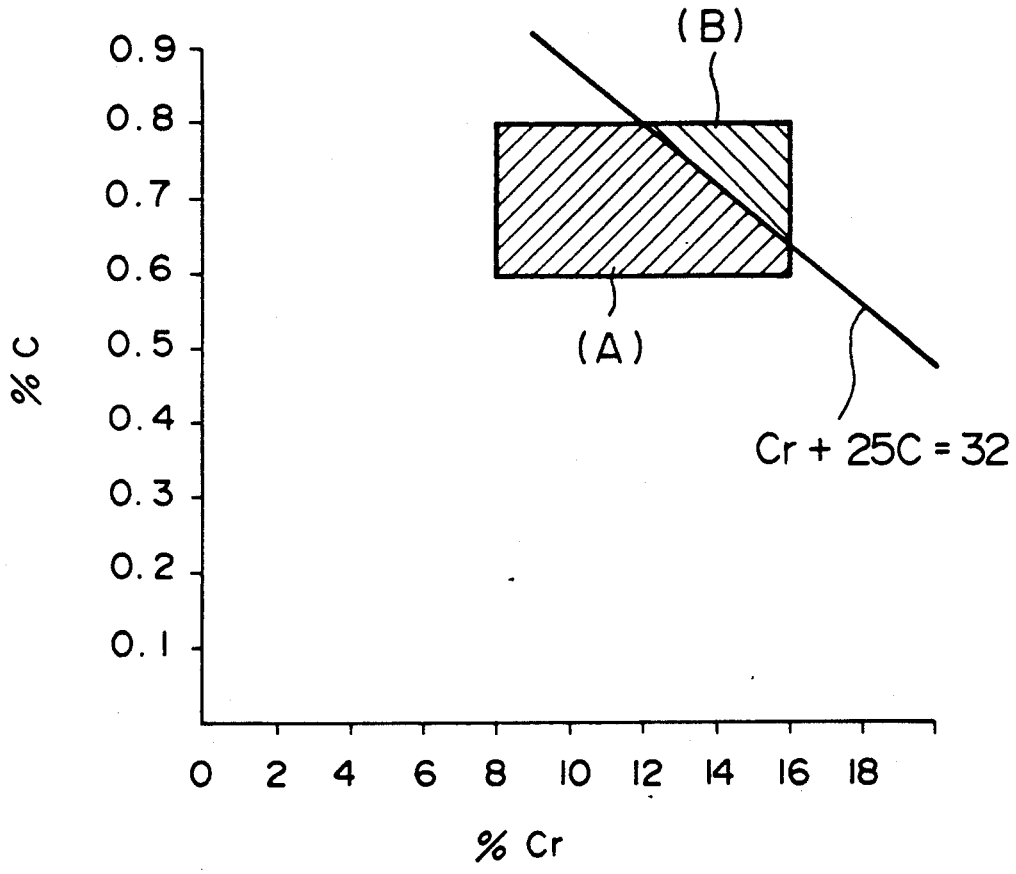
FIG. 2 is a %C-%Cr graph in which areas (A) and (B) according to the present invention are shown.

FIG. 2 shows relation among the amount of C, amount of Cr and area where the primary carbide is produced and designates the areas A and B of the present invention. FIGS. 3A and 3B show the microstructure (x 400) of Sample No. 1 in Table 1 for the area A and Sample No. 5 for the area B which were subjected to the above heat treatments (oil-quenching of 1050° C. ×20 minutes, subzero treatment at −100° C. and tempering at 150° C).

In the above, the present invention has been explained mainly regarding electronic fuel injection nozzles, but the materials of the present invention are superior in corrosion resistance, abrasion resistance and peel resistance in other uses such as pumps for the electronic fuel injection nozzle and other apparatus in which alcoholic fuels are used. Moreover, the materials of the present invention can be produced by the same steps used for production of conventional SUS440C and are more suitable than the conventional materials for members of apparatus in which alcoholic fuels are used.

Furthermore, the materials of the present invention are also superior in abrasion resistance when used for for electronic fuel injection nozzles for usual petroleum fuels and exhibit sufficient structural and performance characteristics.

What is claimed is:

1. A material superior in peel resistance used for members of an apparatus in which alcoholic fuels are used, which comprises, based on weight, 0.60% or more and less than 0.80% of C, 1.5% or less of Si, 1.5% or less of Mn, 8.0% or more and less than 16.0% of Cr, 0.5 to 3.5% of at least one of W and Mo in $\frac{1}{2}$W+Mo, 0.02 to 1.5% of V, 0.05 to 3.0% of Cu and the balance of Fe and unavoidable impurities, the relation between the C content and the Cr content satisfying $\%Cr+25\times\%C \leqq 32$ based on weight, and the ratio of the area of a primary carbide to the total sectional area of the material being 1.5% or less.

2. A material superior in peel resistance used for members of an apparatus in which alcoholic fuels are used, which comprises, based on weight, 0.60% or more and less than 0.80% of C, 1.5% or less of Si, 1.5% or less of Mn, 8.0% or more and less than 16.0% of Cr, 0.5 to 3.5% of at least one of W and Mo in $\frac{1}{2}$W+Mo, 0.02 to 1.5% of V, 0.05 to 3.0% of Cu, 0.1 to 5.0% of Co and the balance of Fe and unavoidable impurities, the relation between the C content and the Cr content satisfying $\%Cr+25\times\% \leqq 32$ based on weight, and the ratio of the area of a primary carbide to the total sectional area of the material being 1.5% or less.

3. A material superior in peel resistance used for members of an apparatus in which alcoholic fuels are used, which comprises, based on weight, 0.60% or more and less than 0.80% of C, 1.5% or less of Si, 1.5% or less of Mn, 8.0% or more and less than 16.0% of Cr, 0.5 to 3.5% of at least one of W and Mo in ½W +Mo, 0.02 to 1.5% of V, 0.05 to 3.0% of Cu, 0.1 to 5.0% of Co, 2.0% or less of Ni and the balance of Fe and unavoidable impurities, the relation between the C content and the Cr content satisfying %Cr+25×%C≦32 based on weight, and the ratio of the area of a primary carbide to the total sectional area of the material being 1.5% or less.

4. A material superior in peel resistance used for members of an apparatus in which alcoholic fuels are used, which comprises, based on weight, 0.60% or more and less than 0.80% of C, 1.5% or less of Si, 1.5% or less of Mn, 8.0% or more and less than 16.0% of Cr, 0.5 to 3.5% of at least one of W and Mo in ½W+Mo, 0.02 to 1.5% of V, 0.05 to 3.0% of Cu, 2.0% or less of Ni and the balance of Fe and unavoidable impurities, the relation between the C content and the Cr content satisfying %CR+25×%C≦32 based on weight, and the ratio of the area of a primary carbide to the total sectional area of the material being 1.5% or less.

5. A material superior in peel resistance used for members of an apparatus in which alcoholic fuels are used, which comprises, based on weight, 0.60% or more and less than 0.80% of C, 1.5% or less of Si, 1.5% or less of Mn, 8.0% or more and less than 16.0% of Cr, 0.5 to 3.5% of at least one of W and Mo in ½W +Mo, 0.02 to 1.5% of V, 0.05 to 3.0% of Cu, and the balance of Fe and unavoidable impurities, the relation between the C content and the Cr content satisfying %Cr+%C>32 based on weight, and the ratio of the area of a primary carbide to the total sectional area of the material being 8.0% or less.

6. A material superior in peel resistance used for members of an apparatus in which alcoholic fuels are used, which comprises, based on weight, 0.60% or more and less than 0.80% of C, 1.5% or less of Si, 1.5% or less of Mn, more than 12.0% and less than 16.0% of Cr, 0.5 to 3.5% of at least one of W and Mo in ½W +Mo, 0.02 to 1.5T of V, 0.05 to 3.0% of Cu, 0.1 to 5.0% of Co, and the balance of Fe and unavoidable impurities, the relation between the C content and the Cr content satisfying %Cr+25×%C>32 based on weight, and the ratio of the area of a primary carbide to the total sectional area of the material being 8.0% or less.

7. A material superior in peel resistance used for members of an apparatus in which alcoholic fuels are used, which comprises, based on weight, 0.60% or more and less than 0.80% of C, 1.5% or less of Si, 1.5% or less of Mn, more than 12.0% and less than 16.0% of Cr, 0.5 to 3.5% of at least one of W and Mo in ½W +Mo, 0.02 to 1.5% of V, 0.05 to 3.0% of Cu, 0.1 to 5.0% of Co, 2.0% or less of Ni and the balance of Fe and unavoidable impurities, the relation between the C content and the Cr content satisfying %Cr+25×%C>32 based on weight, and the ratio of the area of a primary carbide to the total sectional area of the material being 8.0% or less.

8. A material superior in peel resistance used for members of an apparatus in which alcoholic fuels are used, which comprises, based on weight, 0.60% or more and less than 0.80of C, 1.5% or less of Si, 1.5% or less of Mn, more than 12.0% and less than 16.0% of Cr, 0.5 to 3.5% of at least one of W and Mo in ½W +Mo, 0.02 to 1.5% of V, 0.05 to 3.0% of Cu, 2.0% or less of Ni and the balance of Fe and unavoidable impurities, the relation between the C content and the Cr content satisfying %Cr+25×%C>32 based on weight, and the ratio of the area of a primary carbide to the total sectional area of the material being 8.0% or less.

9. A member superior in peel resistance used for making an apparatus in which alcoholic fuels are used, which is made from based on weight, 0.60% or more and less than 0.80% of C, 1.5% or less of Si, 1.5% or less of Mn, 8.0% or more and less than 16.0% of Cr, 0.5 to 3.5% of at least one of W and Mo in ½W +Mo, 0.02 to 1.5% of V, 0.05 to 3.0% of Cu and the balance of Fe and unavoidable impurities, the relation between the C content and the Cr content satisfying %Cr+25×TC≦32 based on weight, the ratio of the area of a primary carbide to the total sectional area of the material being 1.5% or less, and the member having a hardness of HRC 52 or more.

10. A member superior in peel resistance used for making an apparatus in which alcoholic fuels are used, which is made from based on weight, 0.60% or more and less than 0.80% of C, 1.5% or less of Si, 1.5% or less of Mn, 8.0% or more and less than 16.0% of Cr, 0.5 to 3.5% of at least one of W and Mo in ½W+Mo, 0.02 to 1.5% of V, 0.05 to 3.0% of Cu, 0.1 to 5.0% of Co and the balance of Fe and unavoidable impurities, the relation between the C content and the Cr content satisfying %Cr+25×%C≦32 based on weight, the ratio of the area of a primary carbide to the total sectional area of the material being 1.5% or less, and the member having a hardness of HRC 52 or more.

11. The material as in claim 1 wherein the amount of Cu is 0.5–3.0 wt.%.

12. The material as in claim 5, wherein the amount of Cu is 0.5–3.0 wt. %.

13. The material as in claim 1, wherein the amount of V is 0.1–1.0 wt.%.

14. The material as in claim 5, wherein the amount of V is 0.1–1.0 wt.%.

15. The material as in claim 1, wherein the amount of ½W+Mo is 0.5–2.0 wt.%.

16. The materials in claim 5, wherein the amount of ½W+Mo is 0.5–2.0 wt.%.

17. The material as in claim 1, wherein the amount of Co is 0.5–2.5 wt. %.

18. The material as in claim 5, wherein the amount of Co is 0.5–2.5 wt%.

19. A member for use in an alcoholic fuel environment wherein striking impacts would be experienced, fabricated from the material of claim 1.

20. A needle member fabricated from the material of claim 1, for an alcoholic fuel injection apparatus.

* * * * *

UNITED STATES PATENT AND TRADEMARK OFFICE

CERTIFICATE OF CORRECTION

PATENT NO. : 5,169,459

DATED : December 8, 1992

INVENTOR(S) : FUKUSHIMA et al.

It is certified that error appears in the above-identified patent and that said Letters Patent is hereby corrected as shown below:

Claim 2, col. 10, line 61, after "%" (second occurrence), insert --C--.

Claim 6, col. 11, line 39, "1.5T" should read --1.5%--.

Claim 8, col. 12, line 2, "0.80of" should read --0.80% of--.

Claim 9, col. 12, line 19, "TC" should read --%C--.

Claim 16, col. 12, line 48, "materials in" should read --materials as in--.

Title page, item [57] Abstract, line 6, "subjected" should read --subject--.

Signed and Sealed this

Nineteenth Day of October, 1993

Bruce Lehman

*Attest:*

BRUCE LEHMAN

*Attesting Officer*

*Commissioner of Patents and Trademarks*